United States Patent [19]

Lu

[11] Patent Number: 4,858,092

[45] Date of Patent: Aug. 15, 1989

[54] CORDLESS CONDUCTING MEANS FOR LAMP

[76] Inventor: James Lu, 6-3 Fl., No. 512, Sec. 4, Chungsiao E. Rd., Taipei, Taiwan

[21] Appl. No.: 281,018

[22] Filed: Dec. 7, 1988

[51] Int. Cl.[4] ..... F21S 1/12; F21V 21/26

[52] U.S. Cl. ..... 362/413; 362/287; 362/427; 248/74.4; 439/781

[58] Field of Search ..... 362/370, 371, 431, 432, 362/407, 198, 287, 413, 427; 248/74.4, 316.6, 231.6; 439/781, 782

[56] References Cited

U.S. PATENT DOCUMENTS

| | | | |
|---|---|---|---|
| 3,144,506 | 8/1964 | Gunthel, Jr. | 439/781 X |
| 4,449,169 | 5/1984 | Warshawsky | 362/413 |
| 4,449,172 | 5/1984 | Warshawsky | 362/432 X |
| 4,453,204 | 6/1984 | Washawsky | 362/413 X |
| 4,484,255 | 11/1984 | Washawsky | 362/413 X |
| 4,525,773 | 6/1985 | Hesse et al. | 362/413 |
| 4,779,175 | 10/1988 | Chernack | 362/287 X |

FOREIGN PATENT DOCUMENTS

| | | | |
|---|---|---|---|
| 718832 | 3/1942 | Fed. Rep. of Germany | 439/781 |

*Primary Examiner*—Ira S. Lazarus
*Assistant Examiner*—Peggy Neils
*Attorney, Agent, or Firm*—Bacon & Thomas

[57] ABSTRACT

A cordless conducting means for lamps including two half-casings, bent conductors on which a circumferential slots are arranged and two pairs of positioning means which are conductive. The conductors are retained in the positioning means so that electricity can be transmitted via the conductors and the positioning means finally to the bulb. A coat of insulating material is coated on the conductors in order to prevent electrical leakage.

1 Claim, 3 Drawing Sheets

CORDLESS CONDUCTING MEANS FOR LAMP

BACKGROUND OF THE INVENTION

The present invention relates to conducting means for lamps, and more particularly to such a conducting device which is free from the use of wires for transmission of electricity but also has the energy supply function.

In the past, lamps usually comprised a base on which a lamp bracket was located, further having an illuminator attached on the top of the bracket. In general, a wire was used to transmit electricity in the manner that one end of the wire was connected to the base and the other end was connected to the lamp socket to light the bulb. However, in this way, not only the design was restricted but also the bracket had to be formed with a plurality of conduits for wires to pass through. When the wires are exposed outside, it is bad looking.

SUMMARY OF THE INVENTION

In order to mitigate and/or obviate the abovementioned drawbacks in the manner set forth in the detailed description of the preferred embodiment, the objective of the present is to provide a cordless conducting means which connects with a plurality of bent conductors to transmit electricity.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PERFERRED EMBODIMENT

Figure 1:
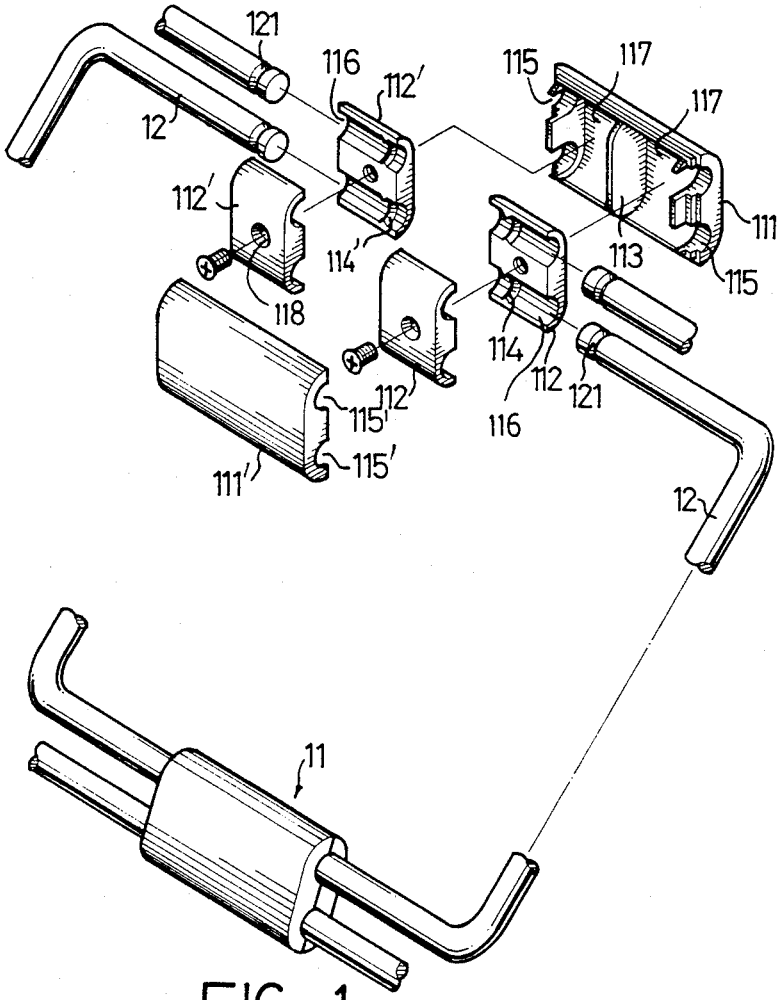
FIG. 1 is an exploded cutaway view of a cordless conducting means in accordance with the present invention.

As best seen in FIG. 1, a conducting means 11 for a lamp comprising two half-casings 111 and 111', which are substantially rectangular and are made of insulating material. Two semi-circular cutouts 115 and 115' are provided on each side of each half-casing 111 and 111', so when the two half-casings 111 and 111' are combined, two holes will be on each side thereof. An insulating baffle 113 is formed integrally in one of the half-casings to divide the half-casing into two equal chambers 117. Two pairs of positioning means 112 and 112' are conductive and splitable into two parts which match each other and are retained in the two equal chambers 117, respectively. Two transversely extending semi-circular recesses 116 are provided in each part of the positioning means 112 and 112' and a protrusion 114 is arranged in each semi-circular recess 116. A screw-away 118 is employed on each of the pairs of positioning means 112 and 112', thereby permitting a screw to pass through, further fastening the two parts together.

A plurality of bent conductors 12 are retained in the semi-circular recesses 116. Respective circumferential slots 121 are disposed at the distal end of each conductor 12. The portions of the bent conductors 12 which are exposed in the outside of the positioning means 112 and 112' have a coat of insulating material respectively thereon in order to prevent current leakage therefrom.

Figure 2:
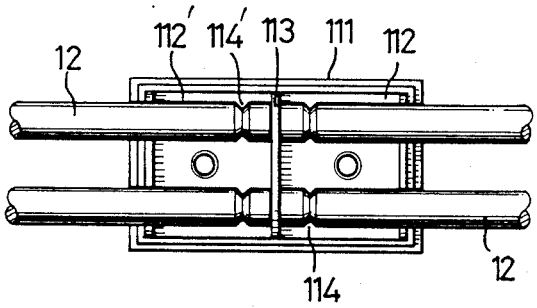
FIG. 2 is a plan view thereof illustrating the conductors engaged with the half-casing.

Referring to FIG. 2, it can be understood that the two chambers 117 of the half-casing 111 receive two positioning means 112 and 112', respectively, so that a plurality of bent conductor 12 can be retained in the semi-circular recesses 116. Additionally, the protrusions 114 in the semi-circular recesses 116 are engaged with the circumferential slots 121 to prevent the bent conductors 12 from moving.

Owing to the insulating baffle 113, the two pairs of positioning means 112 and 112' do not contact each other so a short-circuit does not occur.

Figure 3:
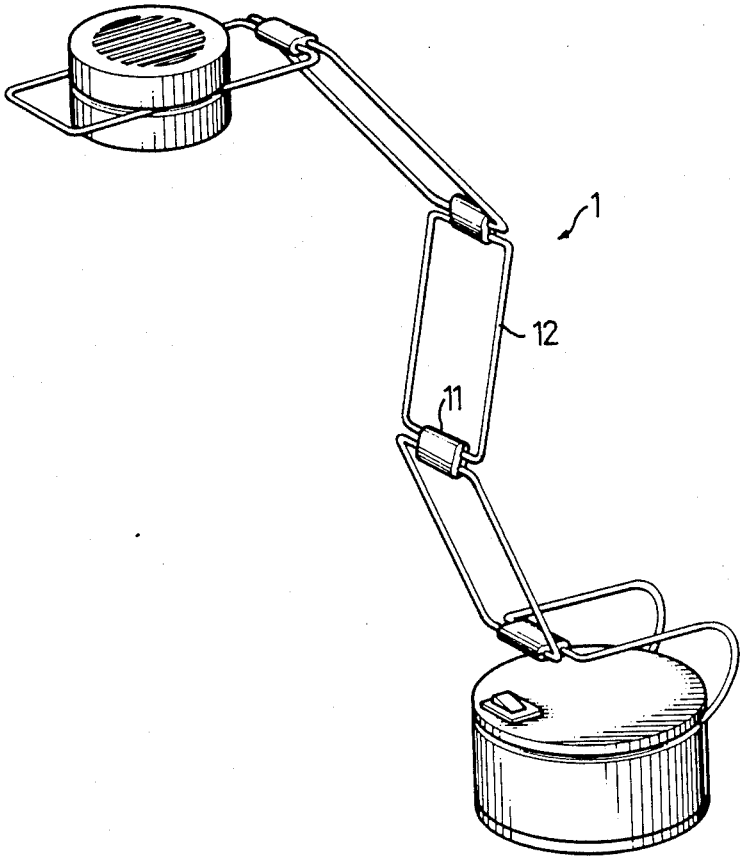
FIG. 3 is a perspective view of a lamp utilizing the present invention to transmit electricity.

As can be seen in FIG. 3, the conducting means assembly 11 and bent conductors 12 perform the same function as wires and bracket in a conventional lamp to transmit electricity. Furthermore, the bent conductors 12 are pivotable about the conducting means 11 so that the bracket could be any desired form.

While the invention has been explained in relation to its preferred embodiments, it is to be understood that various modification thereof will become apparent to those skilled in the art upon reading this specification. Therefore, it is to be understood that the invention disclosed herein is intended to cover such modifications as fall within the scope of the appended claims.

I claim:

1. A cordless conducting means for a lamp comprising the combination of:

(a) two half-casings which are substantially rectangular and which are made of insulating material, two semi-circular cutouts being provided on each side of each half-casing, an insulating baffle being positioned in one of said half-casings to divide said half-casings into two equal chambers;

(b) two pairs of positioning means which are conductive and splitable into two parts which match each other and which are retained in said chambers, each said pair fitting in a respective chamber, two semicircular recesses being provided in each part and a circular protrusion being arranged in each semicircular recess, each of the pairs of positioning means being threadably secured together; and (c) a plurality of bent conductors which are retained in said semi-circular recesses, a circumferential slot being arranged in an end of each said bent conductors, said bent conductors projecting from said positioning means and having a coat of insulating material thereon.

* * * * *